United States Patent [19]

Glaesener

[11] 3,966,173

[45] June 29, 1976

[54] MEDIAN BARRIER FOR HIGHWAYS AND THE LIKE

[75] Inventor: Ernest Glaesener, Differdange, Luxembourg

[73] Assignee: Aciéries Réunies de Burbach-Eich-Dudelange S.A. ARBED, Luxembourg

[22] Filed: Mar. 18, 1975

[21] Appl. No.: 559,590

[30] Foreign Application Priority Data

Mar. 19, 1974 Germany ..... 2413095

[52] U.S. Cl. ..... 256/13.1; 49/9; 52/98

[51] Int. Cl.[2] ..... A01K 3/00; E01F 15/00

[58] Field of Search ..... 256/13.1, 1; 248/475 R; 49/9, 34, 49; 404/6–9; 52/98

[56] References Cited

UNITED STATES PATENTS

| | | | |
|---|---|---|---|
| 2,123,167 | 7/1938 | Cain | 256/13.1 |
| 3,284,054 | 11/1966 | Pierre | 256/13.1 |
| 3,332,666 | 7/1967 | Gray | 256/13.1 |
| 3,499,630 | 3/1970 | Dashio | 256/13.1 |

FOREIGN PATENTS OR APPLICATIONS

| | | | |
|---|---|---|---|
| 254,929 | 10/1966 | Austria | 256/13.1 |
| 228,823 | 1/1963 | Austria | 256/13.1 |

*Primary Examiner*—Paul R. Gilliam
*Attorney, Agent, or Firm*—Karl F. Ross; Herbert Dubno

[57] ABSTRACT

A median barrier for highways separating two vehicle-travel lanes comprises a plurality of preferably breakaway posts forming a rigid center wall and, mounted on the latter, a pair of deflectable guard rails spacedly flanking this wall. Arms extending from the central wall carry the guard rails and are swingable about vertical axes. The central wall is constructed to extend sufficiently high so as to be effective for trucks and other large vehicles while the guard rails are positioned for maximum effectiveness with passenger automobiles.

15 Claims, 5 Drawing Figures

SHEET STEEL
SYNTHETIC RESIN FOAM ρ=80 kg/m3
t=1.2 mm
170 mm
330 mm
BREAKAWAY JOINT
BREAKAWAY JOINT

FIG. 2
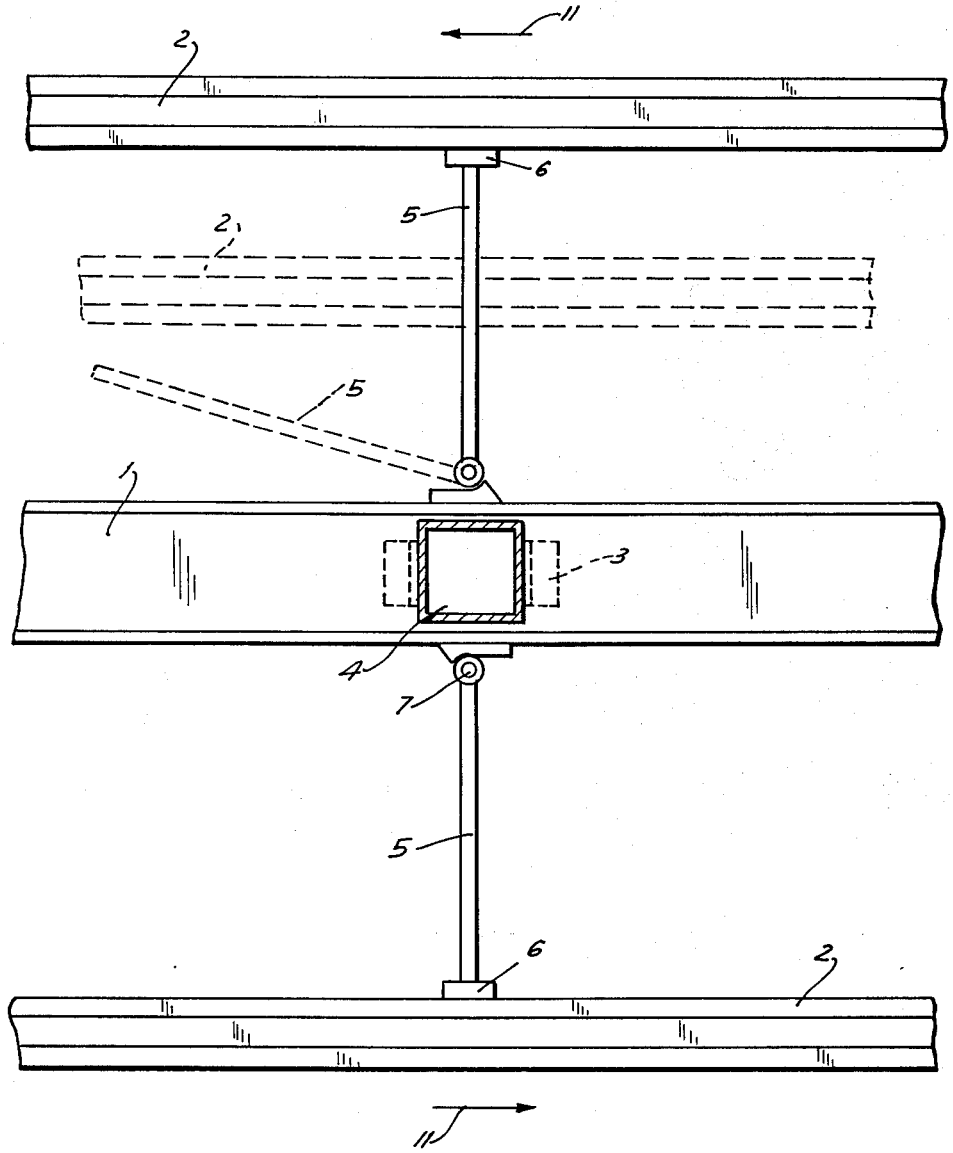
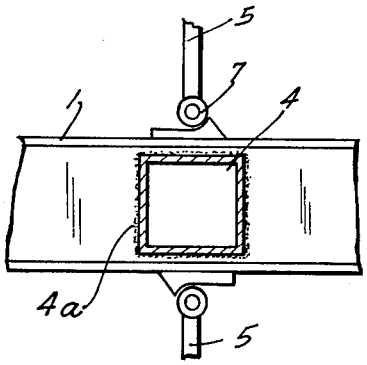
FIG. 3
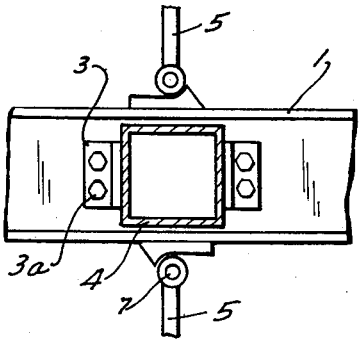
FIG. 4

MEDIAN BARRIER FOR HIGHWAYS AND THE LIKE

CROSS REFERENCE TO RELATED APPLICATIONS

The present application is related to my commonly assigned copending applications Ser. Nos. 539,510 and 373,867 filed 18 Mar. 1975 and 26 June 1973 respectively.

FIELD OF THE INVENTION

The present invention relates to a barrier for a median strip between two lanes of traffic normally moving in opposite directions and, more particularly, to a median barrier between the opposite lanes of a highway or other roadway for high-speed vehicle traffic, especially mixed traffic consisting of trucks and other large vehicles as well as passenger carrying automobiles.

BACKGROUND OF THE INVENTION

Median barriers are provided along highways for high-speed vehicle travel to prevent a vehicle in one lane, out of control, from jumping into the oppositely traveled lane across a median strip and endangering the drivers, passengers, etc. of both the wayward vehicle and oncoming traffic.

It is already known in connection with vehicle guard rails to provide rail structures along a traffic lane which are positioned substantially on the level of the center of gravity of the vehicle to be intercepted and designed to absorb impact energy with a medium of rebounding. The term "rebounding" is used herein to designate the deflection of a vehicle which leaves its lane back into the traffic flow in its original direction. In the last mentioned applications, I have described systems whereby the guard rail is cushioned or formed so as to prevent or limit the breakage of the rail structure or its distortion in a manner leading to the production of sharp edges which might endanger the vehicle passengers. This structure deflects laterally over long distances by the breakaway of its supporting posts so as to allow the rail to form a sling-type loop along which the vehicle slides to prevent rebounding.

Earlier barriers provided a more or less rigid wall which crushed, broke and presented sharp edges or corners which tore the vehicle and endangered its passengers.

To provide assurance that high-speed vehicles would not cross the median barrier, prior efforts at developing effective vehicle controls for this purpose have concentrated upon rigid and massive structures disposed along the median strip.

When, however, the median barrier is provided at the level of the center of gravity for most normal passenger vehicles, it is too low for trucks, buses and similar large vehicles which tend to leap the barrier.

On the other hand, when a rigid rail structure is provided at the level of the center of gravity sufficient to catch most large vehicles, it is well above the major part of the body of a passenger vehicle and is dangerous to the passenger compartment of a passenger vehicle when the latter impacts against the median barrier.

All efforts heretofore to provide a median barrier for use on highways traveled by trucks and like large vehicles in addition to passenger vehicles have hitherto been compromises both as to massive, height and the like considering that trucks and passenger vehicles may differ in weight between 5 and 20-fold while the height of the center of gravity may be twice or three times greater in a truck than in a passenger vehicle.

It will immediately be appreciated that a median rail which is sufficient in mass or rigidity to halt a massive truck will result in complete demolition of a passenger vehicle impacting thereagainst at high speed and will generally be positioned at a level detrimental to the safety of the passengers.

OBJECT OF THE INVENTION

It is the object of the present invention to provide a median barrier having improved characteristics for the interception of passenger vehicles as well as for the interception of trucks and other large vehicles with a minimum of danger that the latter vehicle would be able to break through or leap the barrier.

SUMMARY OF THE INVENTION

This object and others which will become apparent hereinafter are attained, in accordance with the present invention, in a median barrier having a plurality of posts anchored in the ground and preferably provided with breakaway portions, and a substantially rigid center wall extending to a level above the center of gravity of the largest vehicles to be accommodated on the highway and downwardly to a level at least equal to the average position of the center of gravity of a passenger vehicle, the center wall extending continuously along the median strip.

From the center wall, in the direction of the travel lane or lanes, there extend arms which carry yieldable guard rails extending continuously along the median and positioned to engage a catch passenger vehicle, i.e. positioned at a level corresponding substantially to the average level of the center of gravity of passenger-carrying vehicles.

According to a feature of this invention, the center wall comprises a pair of double-T or I-beams disposed such that the main loading movement is perpendicular to the roadway, i.e. with the web of the I-beam horizontal and the flanges thereof vertical. Of course other configurations of the central wall may be used; e.g. the latter may consist of thick-wall hollow-profile girders which are vertically spaced from one another, one being disposed at least 6 centimeters above the ground. These girders need not be spaced apart but may abut one another if desired. It has been found that best results are provided when one of the girders is disposed at the level of the center of gravity of passenger-carrying vehicles and the other at the center of gravity of most heavy trucks and like vehicles.

The rigid wall is provided upon posts which are spaced apart by 3 to 6 meters and are of the breakaway type. More particularly, the post may have an intermediate portion connecting its girder-carrying upper portion with its base which may be weakened or can consist of an inherently brittle material such as cast iron. When the posts are attached to base plates mounted upon the ground, the connecting bolts may be provided with weakened portions or may be inherently capable of breadaway to release the upper post portion.

The passenger-vehicle rails may be provided with shells or hollow profiles of thin sheet metal, filled with a foamed synthetic resin as described in U.S. Pat. No. 3,704,861 or may consist of sheet metal profiles encased in foam synthetic resin as described in application Ser. No. 373,867. The guide rail may also consist of a continuous band, a wire or cable or an array of parallel wires or cables.

The guide rails are supported on spacer arms which extend perpendicularly to the central wall or are inclined to the latter, at a distance of 1 to 2 meters therefrom and are disposed 65 to 75 centimeters above grade. The supports for the guide rails are located 6 or more meters apart and are of the breakaway or deflectable type so that, upon engagement of the vehicle with these guard rails, the guard rail can deflect inwardly and form a sling which is engaged by the vehicle. A passenger vehicle thus encountering the guard rail will be slowed by friction as the vehicle deflects the rail and can come to rest in the space between the travel lane and the central wall without material damage to either the vehicle or the guard rail structure.

Since the central wall and the guard rail have different stiffnesses, passenger vehicles will be primarily engaged by the guard rail and will only encounter the central wall after having been slowed to prevent material damage by impact thereagainst. Even with such impact there is little rebounding and the passenger vehicle will come to rest facing in its original travel direction in the aforementioned space between the central wall and the traveled lane.

When a heavy vehicle such as a truck engages the median barrier, it will in part be slowed by the guard rail and then will encounter the central wall, normally with sufficient dissipation of energy that it will come to rest between the central wall and the traveling lane, facing in its original direction. It should be noted in this connection that even with heavy trucks, the guard rail serves to guide the vehicle into a more or less parallel direction with respect to the central wall.

If a heavy truck is moving at high speed transversely to the median, however, it may impact against the central wall with sufficient energy to cause the posts of the latter to break away, whereupon the girders will deflect slightly to bring the vehicle to rest. In this case damage to the vehicle and to the median barrier is unavoidable, but there is little danger that the truck will turn over or leap the guard rail.

While the system described has its major utility for use in a median barrier, and will be described in connection therewith hereinafter, it should be noted that it also has utility for one-sided protection of a vehicle roadway (in which case only one guard rail need be provided) for bridges, reservoirs, dams, mountainous roads and the like.

BRIEF DESCRIPTION OF THE DRAWING

The above and other objects, features and advantages of the present invention will become more readily apparent from the following description, reference being made to the accompanying drawing in which:

FIG. 2 is a diagrammatic plan view thereof;

FIG. 3 is a section taken along the line III—III of FIG. 1;

FIG. 4 is a section taken along the line IV—IV of FIG. 1; and

SPECIFIC DESCRIPTION

Figures 1, 5:
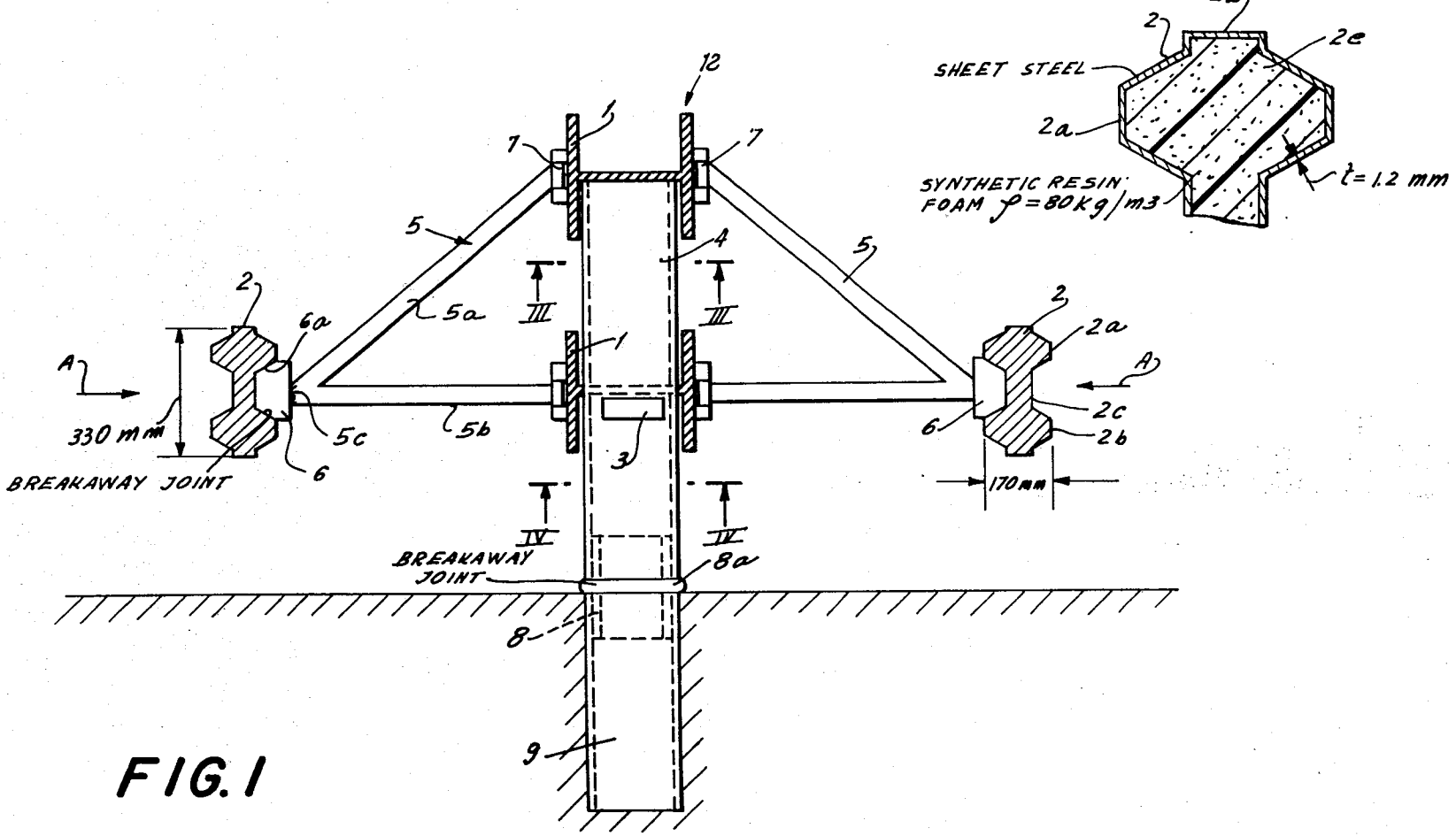
FIG. 1 is a vertical section, partly in diagrammatic form, of a median barrier according to the invention.
FIG. 5 is a detail cross section of the guard rail used in the system of FIGS. 1 and 2.

In FIGS. 1–5 I have shown a median barrier for a highway in which the high speed travel lanes sustain vehicle travel in the opposite directions represented by the arrows 11.

At locations spaced at equal distances of 5 meters from one another and 2 meters inwardly from the edges of the travel lanes, there are provided hollow-profile posts 4 of a side dimension of 120 mm and a wall thickness at 4 mm, the posts being made at least of their upper portions of steel.

As shown in the drawing, the posts are made of two sections, including a socket portion 9 sunk into the ground 10 or embedded in a concrete foundation. The upper portion 4 extends into the socket 9 via a cast iron brittle bottom member 8 welded at a bead **8*a* to the remainder of the post. The brittle member 8 is a breakaway or weakened body allowing impact against the central wall 12 at high energy, to rupture the member 8 and tear away the upper portions of the post 4 from the socket 9**.

The relatively rigid central wall 12 is here shown to comprise two continuous I beams or girders 1 having horizontal webs and a horizontal width of 280 mm, the girders 1 running parallel to the roadway.

The lower girder 1 is provided with openings through which the posts 4 extend and rests upon a pair of steel angles 3 which are bolted at **3*a* to the lower girder (see FIG. 4); the angle irons 3** are located about 80 centimeters above grade.

The upper girder 1 lies at the tops of the posts 4, i.e. about 1.6 meters above grade and are welded at **4*a* to the posts (see FIG. 3**).

On both sides of the center wall 12 and spaced at the 1.5 meters therefrom and 70 centimeters above grade, there are provided deflectable guard rails 2. The latter rails mayabe constructed as described in the aforementioned copending application or the prior patents. Preferably as shown in FIG. 5, the rails 2 consist of sheet metal shells **2*d* having a thickness of 1.2 mm (steel) filled with a synthetic resin foam 2*e*, e.g. a polyurethane, with a density of above 80 kilograms per meter$^3$. The guard rail 2 has a figure-8-profile with a pair of ribs 2*a*, 2*b* separated by an intervening channel or groove 2*c***.

The rails 2 have a horizontal width of 170 mm and a height of 330 mm and are supported at distances of 8 meters from one another by fork-like arms or spacers 5 which are hinged at 7 for swinging movement about vertical axes upon the wall 12. The spacers 5 are welded to feet 6 which are tacked at **6*a* to the sheet metal skin of the guard rails so that these feet readily breakaway from the guard rail upon impact by a vehicle. Of course the junction between the feet 6 and the arms 5** can also be of the breakaway type.

Upon impact of a passenger vehicle with the guard rail, the arms 5 will swing away upon breaking loose, (see broken line showing in FIG. 2) and permit the rail 2 to deflect inwardly. The vehicle thereby guided along this rail and may move off the travel lane without danger to its passengers. The girders and the guard rails are welded together continuously over the length of the median barrier.

When reference is made to a central wall 12, therefore it is intended to define thereby a structure which is very rigid by contrast with the readily deflectable guard rail 2. Of course, the center wall need not be closed but may have the configuration of a mesh fence or other fence-like structure provided that it is capable of absorbing the impact of a truck or the like.

I claim:

1. A roadway barrier adapted to be constructed along a travel lane for passenger and heavier vehicles, comprising:

a row of upright posts spaced apart along said lane and transversely spaced therefrom;

a substantially rigid continuous wall mounted on said posts and spaced from the proximal edge of said lane, said wall extending continuously along said row;

a guard rail positioned to intercept passenger vehicles and extending continuously along said lane between said wall and said edge, said guard rail being laterally deflectable more readily than said wall and being disposed at a height enabling it to intercept said passenger vehicles; and spacers mounted on said wall a projecting laterally therefrom to support said guard rails at a distance of 1 to 2 meters form said wall, said wall having a heavy-vehicle intercepting portion spaced above said guard rail and lying at a level above the centers of gravity of heavy vehicles adapted to use said lane, said spacers being connected to said guard rails at respective breakaway portions.

2. The barrier defined in claim 1 wherein said posts are provided with breakaway portions enabling lateral dislocation of said wall.

3. The barrier defined in claim 2 wherein said wall is a central wall disposed between two opposite traffic lanes and said barrier is provided with a respective continuous guard rail on each side of said wall and respective spacers supporting each of said guard rails on said central wall.

4. The barrier defined in claim 3 wherein said wall comprises at least one girder having a substantially horizontal wall and a pair of vertical flanges.

5. The barrier defined in claim 4 wherein said central wall comprises at least two such girders in vertically spaced relation mounted on said posts.

6. The barrier defined in claim 3 wherein said central wall has an upper edge disposed between 100 and 180 centimeters above grade and a lower edge disposed at least 60 centimeters above grade.

7. The barrier defined in claim 3 wherein said posts are mutually spaced at distances of 3 to 6 meters from one another.

8. The barrier defined in claim 3 wherein said guard rail consists of a hollow sheet metal profile and a mass of foamed synthetic resin bonded thereto.

9. The barrier defined in claim 3 wherein said guard rails are spaced from said central wall by distances of 1 to 2 meters aand are disposed 65 to 75 meters above grade.

10. The bar defined in claim 3 wherein the spacers on each side of said central wall are spaced apart by distances of at least 6 meters.

11. The barrier defined in claim 3 wherein said spacers are connected to said guard rails at respective breakaway portions.

12. The barrier defined in claim 3 wherein the spacers are arms projecting from said central wall and higned thereto for pivotal movement about vertical axes.

13. The barrier defined in claim 3 wherein said spacers are fastened to the respective guard rails at locations offset from other locations of attachment to said wall in the direction of vehicle travel along the respective lane.

14. The barrier defined in claim 3 wherein said central wall comprises a horizontal girder extending along said posts at the level of said guard rail and another horizontal girder lying above the first mounted girder.

15. The barrier defined in claim 3 wherein said rail extends continuously along said barrier.

* * * * *